US005678983A

United States Patent [19]

Lilie

[11] Patent Number: 5,678,983

[45] Date of Patent: Oct. 21, 1997

[54] DISCHARGE FLUID ACTUATED ASSIST FOR OPENING AN OUTLET REED VALVE OF A HERMETIC COMPRESSOR SYSTEM

[75] Inventor: Dietmar Erich Bernhard Lilie, Joinville - SC, Brazil

[73] Assignee: Empresa Brasileira De Compressores S/A - Embraco, Joinville - SC, Brazil

[21] Appl. No.: 535,108

[22] PCT Filed: May 2, 1994

[86] PCT No.: PCT/BR94/00018

§ 371 Date: Feb. 26, 1996

§ 102(e) Date: Feb. 26, 1996

[87] PCT Pub. No.: WO94/27047

PCT Pub. Date: Nov. 24, 1994

[30] Foreign Application Priority Data

May 7, 1993 [BR] Brazil ..... 9301059

[51] Int. Cl.[6] ..... F04B 53/10

[52] U.S. Cl. ..... 417/297; 417/569; 137/855

[58] Field of Search ..... 417/297, 300, 417/446, 507, 569; 251/281; 137/855, 514

[56] References Cited

FOREIGN PATENT DOCUMENTS

| | | |
|---|---|---|
| 0 075 097 | 3/1983 | European Pat. Off. . |
| 2 663 393 | 12/1991 | France . |
| 60-075 782 | 4/1985 | Japan . |

*Primary Examiner*—Roland G. McAndrews, Jr.
*Attorney, Agent, or Firm*—Darby & Darby

[57] ABSTRACT

Discharge valve actuating system for hermetic compressors of the type having a piston (3) reciprocating inside a cylinder (2) which pumps gas to a discharge chamber (22) maintained in selective fluid communication with the cylinder (2) through a discharge orifice (12) provided on a valve plate (10) and closed by a respective reed discharge valve (40). There is at least one subchamber (70) which maintains with the discharge chamber (22) a fluid communication that is constantly blocked by a movable blocking element (60) which moves between an operative position of contact with the discharge valve (40) when at a closed position and an inoperative position of spacing from said discharge valve (40). The inoperative and operative positions are defined as a function of the pressure inside the discharge chamber (2) in relation to the pressure existing in the subchamber (70) during each pumping cycle of the piston (3).

14 Claims, 2 Drawing Sheets

DISCHARGE FLUID ACTUATED ASSIST FOR OPENING AN OUTLET REED VALVE OF A HERMETIC COMPRESSOR SYSTEM

FIELD OF THE INVENTION

The present invention refers to a discharge valve actuating system for reciprocating hermetic compressors such as are used in small refrigerating appliances and which are provided with a discharge valve having an impelling means.

BACKGROUND OF THE INVENTION

Reciprocating hermetic compressors for refrigeration are provided with a block, which is mounted inside a hermetically sealed shell. In said block, there is a cylinder, in which reciprocates a piston, which is driven by the shaft of an electric motor through a connecting rod, in order to effect the suction and compression of a refrigerant gas.

The cylinder presents an end, which is opposite to that end by which the piston is articulated to the connecting rod, and which is opened to a valve plate, which separates the internal cavity of said cylinder from a cylinder head, where the discharge and suction chambers of the compressor are defined. The communication between the internal cavity of the cylinder and each of said chambers is made through discharge and suction orifices provided on said valve plate, which are periodically and selectively closed by respective discharge and suction valves mounted on said valve plate.

For reasons of constructive simplicity, these compressors use suction and discharge valves of the reed type which, together with the piston, produce an intermittent flow of refrigerant gas. These systems further have muffler assemblies or acoustic filters, mounted at the suction and discharge lines of the compressor in order to attenuate the noises caused by said intermittent flow of refrigerant gas.

Such muffler assemblies include at least one discharge muffler, where the compressed gas coming from the compressor is expanded, reducing its pressure and, consequently, reducing the noise intensity.

The known discharge mufflers are usually defined by a chamber, which is formed in the cast block of the cylinder and which has a first channel, communicating with the discharge chamber, and a second channel, communicating with the discharge tube or, in some constructions, with a second discharge muffler chamber.

It is known that during the discharge of the refrigerant gas to the discharge chamber, the hermetic compressors present yield loss, resulting from the late opening of the discharge valve. This means that the discharge valve is opened at an instant of time after the instant at which the discharge pressure is achieved, i.e., the pressure inside the cylinder at the compression end has surpassed that minimum pressure needed to cause the opening of the discharge valve. This late opening results from inertial problems of the valve movement, due to its construction characteristics, or from a gluing effect of the contact surface of said discharge valve with an oil film existing on the valve seat.

A solution to eliminate the problem of opening delay of the discharge valve during compression is by using a valve impelling means, which actuates together with said discharge valve, as described in the Brazilian patent document PI 9002967.

Nevertheless, as in this solution the valve impelling means is constantly actuating together with the discharge valve, forcing the latter to open, the closing of said valve is impaired. This constant actuation of the impelling means allows a gas backflow to the cylinder inside, with a consequent volumetric loss for the compressor.

OBJECTS OF THE INVENTION

Thus, it is a general object of the present invention to provide a discharge valve actuating system for reciprocating hermetic compressors, which minimizes the effect of the forces acting on the discharge valve that delay its opening during compression, thereby increasing the compressor yield, without impairing the closing of said discharge valve.

It is another object of the present invention to provide a discharge valve actuating system for reciprocating hermetic compressors of the above type, which minimizes the effect of the forces that delay the opening of said valve by using the power available in the compressor.

BRIEF DESCRIPTION OF THE INVENTION

These and other objectives are achieved by a discharge valve actuating system for reciprocating hermetic compressors, of the type comprising a piston reciprocating inside a cylinder; a valve plate closing a pumping end of the cylinder and a cylinder head, attached to the valve plate in order to define with the latter a discharge chamber. The discharge chamber is maintained in selective fluid communication with the cylinder through a discharge orifice, which is provided on the valve plate and which is closed by a respective reed discharge valve. There is at least one subchamber which maintains with the discharge chamber a fluid communication that is constantly blocked by a moveable blocking element which moves between an operative position, defined when the pressure in the discharge chamber and in the subchamber are substantially the same, and an inoperative position, displaced towards the subchamber and achieved whenever the pressure inside the discharge chamber surpasses the pressure of the subchamber by a value sufficient to cause said displacement of the blocking element from the inoperative position to the operative position. The blocking element is constantly and elastically forced to the operative position, in which said blocking element applies on the discharge valve a force to move the latter from its closed position to a position spaced form the discharge orifice.

BRIEF DESCRIPTION OF THE DRAWINGS

The invention will be described below, with reference to the attached drawings, in which.

DETAILED DESCRIPTION OF THE INVENTION

Figure 1:
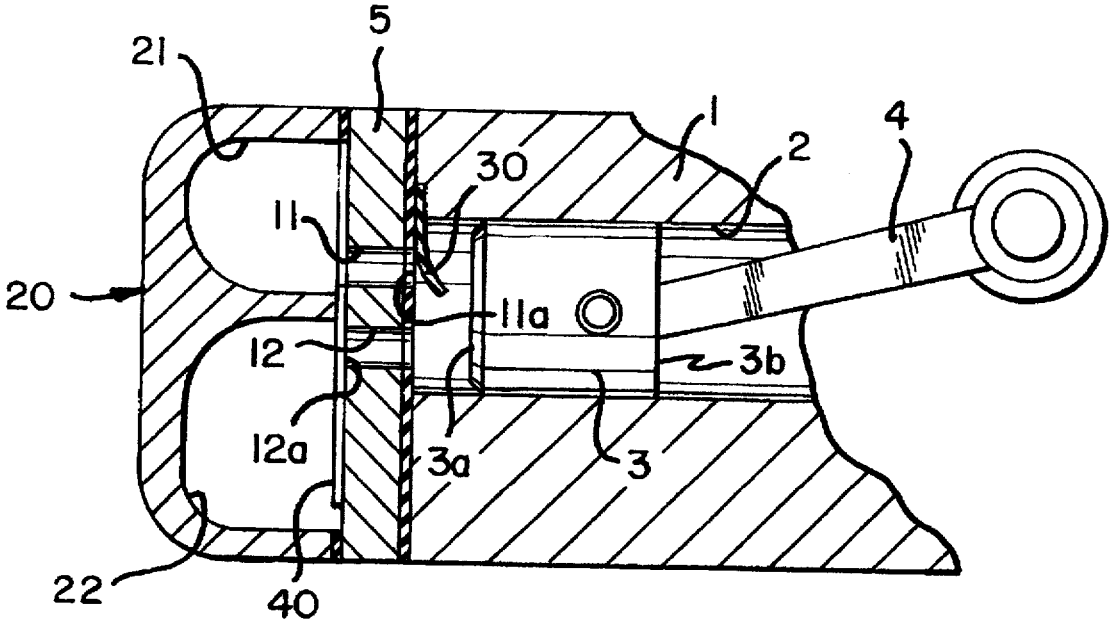
FIG. 1 PRIOR ART
FIG. 1 is a partial horizontal sectional view of the cylinder block of a prior art compressor, illustrating the cylinder and the gas suction and discharge chambers, formed between the cylinder head and the valve plate.
Figure 2:
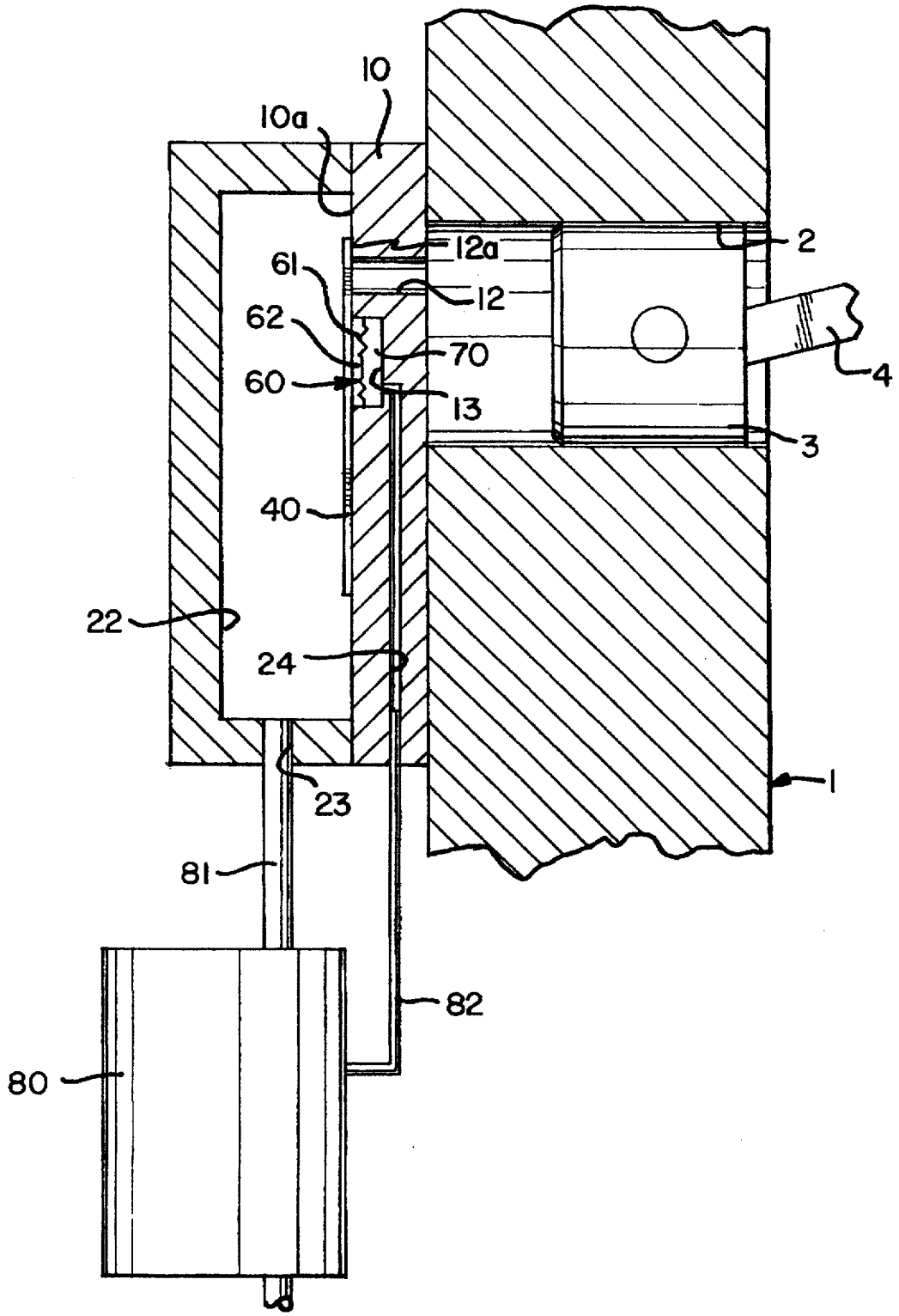
FIG. 2 illustrates schematically a partial horizontal sectional view of details of part of FIG. 1 showing the discharge chamber and the discharge muffler chamber in a compressor provided with the valve actuating system of the present invention.

According to FIGS. 1 and 2, the reciprocating hermetic compressor of the present invention comprises a cylinder block 1 defining a cylinder 2 in which reciprocates a piston 3 driven by a connecting rod 4. The cylinder block 1 presents a pair of opposite faces, to which are opened the ends of the cylinder 2. A valve plate 10 and a cylinder head 20 are attached against one of said opposite faces of the cylinder 1.

The cylinder head 20 together with said valve plate 10 forms two internal cavities, one of which defines a suction chamber 21 and the other a discharge chamber 22.

The cylinder 2 maintains a selective fluid communication with said suction chamber 21 and surcharge chamber 22 through respective gas suction and discharge orifices 11 and 12 provided on the valve plate 10 in which are mounted respective suction valve 30 and discharge valve 40, both of the reed type, which are actuated during the suction and discharge strokes of the operative cycle of the reciprocating piston 3. Each said valve, when at the closed condition, presents a sealing portion seated on a corresponding valve seat 11*a*, 12*a*, defined at an adjacent portion of the respective orifice of the valve plate 10, the discharge valve 40 being mounted against a front face 10*a* of the valve plate 10 facing the inside of the discharge chamber 22.

In the known compressors, the opening of the discharge valve 40, even when it is a valve with an impelling means such as described in the Brazilian patent application PI 9002967 of the same applicant, is obtained when the pressure inside the cylinder 2, together with the force of the impelling means (if there is one), results in an opening force upstream of said discharge valve 40, corresponding to the summing of the retarding forces acting on said discharge valve 40 in order to keep the latter seated on the respective valve seat 12*a*. Nevertheless, the action of this opening force can only overcome the retarding forces at an instant of time after the instant in which the pressure in the cylinder 2 reaches its discharge value. Moreover, the compressors in which there is an impelling means to minimize this time difference, present the inconvenience of having the impelling means permanently active thereby impairing the closing of the discharge valve 40.

These retarding forces include inertia of movement of said discharge valve 40 and an effect of adhesion of the latter on the corresponding valve seat 12*a* caused by the presence of an oil fill between one portion of the lower face of the discharge valve 40 facing the valve plate 10 and said valve seat 12*a* of said discharge valve 40.

The valve plate 10 has at its front face 10*a* recessed portion 13, which is provided adjacent to the discharge orifice 12 and which lodges therewithin a pneumatic valve impelling means 60 disposed in such a way as to actuate against the face of the discharge valve 40 facing the valve plate 10 in order to cause the opening of said discharge valve 40, at least at the final phase of the compression stroke, the actuation beginning after a certain time of the compression end has elapsed.

The impelling means 60 defines between the discharge chamber 22 and said recessed portion 13 a subchamber 70 adjacent to the discharge chamber 22 and separated therefrom by a movable blocking element, or wall, in order to avoid any direct fluid communication with said discharge chamber 22 through the recessed portion 13.

A constant fluid communication with the discharge chamber 22 occurs through an intermediate connecting volume 80 through which the compression gas flows before reaching the subchamber 70. In the illustrated construction, said intermediate connecting volume 80 is defined by a discharge muffler chamber, provided in the cylinder block 1.

The impelling means 60 has an operative position, defined when the pressure in the discharge chamber 22 substantially equals the pressure in the subchamber 70, and an inoperative position, displaced towards the subchamber, when the pressure in the discharge chamber 22 is higher than that of the subchamber 70. The impelling means is maintained elastically in this condition while there is a pressure differential between the discharge chamber 22 and the subchamber 70. In the operative position, the impelling means 60 keeps contact with the discharge valve 40 at least at one point of the latter. In the preferred illustrated form, said contact is unique, the valve impelling means 60 being designed in such a way as to exert an opening force against the discharge valve 40 without causing torsion or twisting on the latter around its longitudinal axis.

The use of an intermediate volume 80 prevents the pressure variations in the discharge chamber 22 from being transmitted to the subchamber 70. This avoids submitting the impelling means 60, and consequently the discharge valve 40, to an opening force before the programmed opening instant, thereby impairing the adequate closing of the discharge valve 40. Moreover, said intermediate volume 80 is constructed in such a way that the compression gas propagating to the subchamber 70 reaches the latter within a time after the closing of the discharge valve 40 without affecting said closing and in time to cause a new operative condition of the valve impelling means 60 before a new discharge pressure is reached in the cylinder 2. The operative condition of the valve impelling means 60 is associated with a condition of pressure balance between the subchamber 70 and the discharge chamber 22 established after a determined time interval for the closing of the discharge valve 40 has elapsed, said balance actuating the impelling means 60 until the instant of a new opening of the discharge valve.

In the illustrated construction, the valve impelling means 60 comprises a separating element 61, such as a flexible pneumatic membrane, carrying a valve actuating means 62. The flexible membrane is mounted in the recessed portion 13 separating the subchamber 70 from the discharge chamber 22 and avoiding the fluid communication therebetween.

In this construction it is possible to provide the subchamber 70 with a protecting stop which acts against the impelling means 60 so as to limit the retracting displacement of the latter and, consequently, its bending, to a deformation at maximum slightly larger than that needed to obtain and maintain the spacing between the valve actuating means 62 and the discharge valve 40, upon the sudden pressure rise in the discharge chamber 22 during the opening of said discharge valve 40.

The valve actuating means 62 is in the form of a pneumatic valve actuating means, projecting from the flexible membrane 61 and having a connecting end through which said valve actuating means 62 is attached to said flexible membrane 61. The valve actuating means has an opposite free end which is in contact with an adjacent portion of the discharge valve 40 when the latter is at its closed position and the valve actuating means 62 is at an operative condition, achieved by the pressure balance between the discharge chamber 22 and subchamber 70.

In this operative condition, the valve actuating means 62 remains temporarily forcing the discharge valve 40 to a partial opening condition, when said discharge valve 40 is not subjected to the retarding forces acting thereon and is maintained adhered to the respective valve seat 12*a* until the opening of said valve.

In the illustrated embodiments, the communication between the discharge muffler chamber 80 and the discharge chamber 22 is made through a first gas conducting tube 81 which is opened to the inside of the discharge chamber 22 by means of a throughbore 23 provided in the body of the cylinder head 20 transversely to the wall adjacent to the discharge muffler chamber 80. The communication between the muffler chamber and the subchamber 70 is made through a second gas conducting tube 82, having one end mounted in the discharge muffler chamber 80 and an opposite end connected to a first end of a through channel 24, provided along a portion of the valve plate 10, the second end of said channel, opposite to the first end, being opened to the subchamber 70.

According to the present invention, when the pressure inside the cylinder 2 reaches the discharge pressure, the discharge valve 40 opens instantaneously, allowing the gas compressed inside the cylinder 2 to reach the discharge chamber 22 by passing though the discharge orifice 12. This opening is due to the action of the valve impelling means 60 on said discharge valve 40, liberating said valve from the action of the retarding forces and forcing it to the partial opening position, as described above.

The opening of the discharge valve 40 generates a temporary pressure rise in the discharge chamber 22, causing a pressure unbalance between the latter and the subchamber 70. This pressure rise in the discharge chamber 22 forces the impelling means 60 to a retracting inoperative position when said impelling means is separated from the adjacent portion of the discharge valve 40, said inoperative position lasting till the pressure in the subchamber 70 equals the pressure in the discharge chamber 22 and again causes the operative position of the valve actuating means 62. This separation may occur by the individual retraction of the flexible membrane 61, as well as of the valve actuating means 62, in case both are reactive to the pressure variations between the discharge chamber 22 and subchamber 70.

The retracting condition of the impelling means 60 will last during the time there is a pressure unbalance between the discharge chamber 22 and subchamber 70. This unbalance lasts till after the closing condition of the discharge valve 40 is reached. The time to return to the balance condition, and consequently to the operative position of the valve actuating means 62, is calculated so that said condition is reached before a new condition of discharge pressure inside the cylinder.

The return time to the pressure balance condition corresponds to the time the compressed gas takes to flow from the discharge chamber 22 to the subchamber 70, which means the time needed by said gas to pass through the intermediate volume 80 or, according to the preferred illustrated form, through the discharge muffler chamber 80.

The balance condition may occur at any instant of time after the closing of the discharge valve 40.

According to the present invention, the balance condition is achieved at a time close to that in which a new condition of gas discharge pressure in the cylinder is reached. This avoids that possible oscillations, that by chance were not attenuated in the intermediate volume, be transmitted to the valve impelling means 60, leading the discharge valve 40 to an early inadequate partial opening condition.

The valve actuating means 62 may also be in the form of a stiff element, such as an impelling needle, which maintains a selective contact with the adjacent sealing portion of the discharge valve 40. In the opening of the latter, the highest pressure in the discharge chamber 22 exerts a force on the flexible membrane 61, in the direction of retraction thereof relative to the discharge valve 40. This force results in the retraction of said impelling needle, avoiding any contact with the discharge valve 40, even when the latter is in the closed condition.

In another embodiment of the invention (not illustrated), the impelling needle, or stem, is mounted to a flexible membrane, such as described above, attached to a receiving recess provided on the internal wall of the cylinder head 20 and opposite to the valve plate 10, so that the free end of said impelling needle keeps contact with a portion of the upper face of the discharge valve 40, opposite to the sealing portion of the latter.

Though not illustrated, other constructions are also possible, in which the actuation of the discharge valve 40 is made by more than one impelling means mounted in subchambers 70. Moreover, at least one of said subchambers 70 may be defined spaced from or adjacent to the cylinder head. These solutions further include the possibility of the subchambers 70 being hermetic, defining chambers of predetermined constant pressure.

Either one of said constructions permits achieving a valve opening at an instant of time closer to the instant in which the discharge pressure is reached inside the cylinder 2, without however affecting or even altering the closing of said discharge valve 40 during the operative cycle of the reciprocating piston 3.

Though the above description refers to constructions directed only to the discharge valve of the hermetic compressor, said solutions may also be applied to the suction valve.

I claim:

1. Discharge valve actuating system for hermetic compressors, of the type comprising a piston reciprocating inside a cylinder, a valve plate closing a pumping end of the cylinder, and a cylinder head attached to the valve plate to define therewith a discharge chamber which is maintained in selective fluid communication with the cylinder through a discharge orifice provided on the valve plate and which is closed by a respective reed discharge valve comprising:

at least one subchamber which maintains with the discharge chamber a direct fluid communication that is constantly blocked by a movable blocking element which is moved between an operative position when the pressure in the discharge chamber and in the subchamber are substantially the same and an inoperative position displaced towards the subchamber whenever the pressure of the subchamber relative to that of the discharge chamber is of a value sufficient to cause said displacement of the blocking element from the operative position to the inoperative position, said blocking element being elastically biased to the operative position in which said blocking element applies on the discharge valve a force to move the discharge valve from its closed position to a position spaced from the discharge orifice.

2. Discharge valve actuating system, as in claim 1, wherein said at least one subchamber is adjacent to said discharge chamber in said valve plate.

3. Discharge valve actuating system, as in claim 2, wherein each said at least one subchamber is defined in a respective recessed portion provided in one of the internal walls of said discharge chamber.

4. Discharge valve actuating system, as in claim 3, wherein said recessed portion is provided on said valve plate at a portion thereof adjacent to said discharge orifice.

5. Discharge valve actuating system, as in claim 1, wherein said blocking element keeps contact with the discharge valve at least at one point.

6. Discharge valve actuating system, as in claim 1, wherein the at least one subchamber maintains a permanent fluid communication with the discharge chamber through a connecting intermediate volume which is dimensioned to avoid the instantaneous transfer of pressure from the discharge chamber to the at least one subchamber.

7. Discharge valve actuating system, as in claim 6, wherein the connecting intermediate volume includes at least one discharge muffler chamber of the compressor in constant fluid communication with the discharge chamber and the subchamber.

8. Discharge valve actuating system, as in claim 6, wherein the at least one subchamber maintains a fluid communication with the connecting intermediate volume by a through channel in one of the walls of the discharge chamber.

9. Discharge valve actuating system, as in claim 8, wherein the through channel is provided through the valve plate between one end thereof adjacent to the connecting intermediate volume and the subchamber.

10. A hermetic compressor comprising:

a cylinder within which a piston is driven;

a valve plate at one end of the cylinder having a discharge port for gas compressed by the piston;

an elastic reed valve fastened to said valve plate, biased to normally close said discharge port and to open said discharge port upon the gas compressed in said cylinder reaching a predetermined pressure;

a discharge head on said valve plate forming a discharge chamber into which the compressed gas discharges through said discharge port;

a sub-chamber formed on said valve plate below a part of said reed valve;

a conduit defining a gas flow path between said discharge chamber and said sub-chamber to provide a force to assist moving said reed valve to an open position in combination with the compressed gas in the cylinder.

11. A hermetic compressor as in claim 10 further comprising a member in said sub-chamber to prevent direct gas flow communication between said discharge chamber and said sub-chamber.

12. A hermetic compressor as in claim 11 wherein said member comprises an elastic element and a contacting member actuated by said elastic element that engages said reed valve to assist in moving said reed valve to the open position.

13. A hermetic compressor as in claim 10 wherein said conduit that defines said gas flow path includes a muffler chamber in communication with said discharge chamber.

14. A hermetic compressor as in claim 11 wherein said conduit that defines said gas flow path includes a muffler chamber in communication with said discharge chamber.

* * * * *